US007502281B2

(12) United States Patent
Rund

(10) Patent No.: US 7,502,281 B2
(45) Date of Patent: Mar. 10, 2009

(54) TIMER HAVING A VARIABLE MODE DISPLAY

(75) Inventor: Richard Rund, 9214 Sterling Montague Dr., Great Falls, VA (US) 22066

(73) Assignee: Richard Rund, Great Falls, VA (US)

( * ) Notice: Subject to any disclaimer, the term of this patent is extended or adjusted under 35 U.S.C. 154(b) by 442 days.

(21) Appl. No.: 10/935,359

(22) Filed: Sep. 8, 2004

(65) Prior Publication Data

US 2005/0135196 A1 Jun. 23, 2005

Related U.S. Application Data

(63) Continuation-in-part of application No. 10/394,169, filed on Mar. 24, 2003, now abandoned.

(60) Provisional application No. 60/399,456, filed on Jul. 31, 2002.

(51) Int. Cl.
*G04C 19/00* (2006.01)
*G04C 21/00* (2006.01)
*G04F 8/00* (2006.01)

(52) U.S. Cl. ..... 368/82; 368/109; 368/250

(58) Field of Classification Search ..... 368/89, 368/98, 82, 107–109, 113, 155–156, 239, 368/251

See application file for complete search history.

(56) References Cited

U.S. PATENT DOCUMENTS 3,976,867 A * 8/1976 Campbell ..... 708/111
4,005,571 A * 2/1977 Wolff ..... 368/108
4,245,335 A * 1/1981 Wiesner ..... 368/70
4,264,966 A 4/1981 Terzian
4,280,209 A * 7/1981 Mooney ..... 368/71
4,367,527 A 1/1983 Desjacques
4,385,841 A * 5/1983 Kramer ..... 368/29
4,618,265 A * 10/1986 Wadowski ..... 368/82
4,797,864 A * 1/1989 Stano et al. ..... 368/111
4,887,249 A * 12/1989 Thinesen ..... 368/10
4,896,307 A 1/1990 Marx et al.
4,993,004 A * 2/1991 Loizeaux ..... 368/107
5,058,085 A * 10/1991 Lawler ..... 368/28
5,220,540 A * 6/1993 Nishida et al. ..... 368/41
5,408,446 A * 4/1995 Ohira ..... 368/110
6,069,848 A * 5/2000 McDonald et al. ..... 368/107
6,144,619 A * 11/2000 Reisman ..... 368/10
2004/0008589 A1* 1/2004 McMillan et al. ..... 368/223

OTHER PUBLICATIONS

Myson Technology, Inc., MTU 410 4-Bit Microcontroller with LCD Driver, User Manual, May 6, 1998, Revision 3.0, p. 1-46.

* cited by examiner

*Primary Examiner*—Vit W Miska

(57) ABSTRACT

A timer includes a timing device that generates first and second time counts responsive to user input. A display is provided that displays the first time count in one of a first set of time units and a second set of time units. A user actuatable device is operatively connected to said display and causes the display to clear the first time count and display the second time count.

7 Claims, 2 Drawing Sheets

TIMER HAVING A VARIABLE MODE DISPLAY

This application is a continuation-in-part of application Ser. No. 10/394,169 filed Mar. 24, 2003 and that claims priority from provisional application Ser. No. 60/399,456 filed Jul. 31, 2002.

I. FIELD OF THE INVENTION

This invention relates to time measurement devices and more particularly to timers and chronographs having displays with switchable time units.

II. BACKGROUND OF THE INVENTION

Various conventional devices permit measurement of different time intervals. For example, stopwatches are capable of measuring a period of time to hundredths or thousandths of a second, with the press of a single button. Such devices have various advantageous features, such as the ability to time multiple runners within the same race. Other examples include "kitchen timers", which may be used to measure an amount of cooking time. Such devices may be capable of counting "up" (i.e. measuring an indefinite period of time starting from a time zero) or "down" (i.e., counting down from a preset time until zero).

Since the many events being measured by timing devices may vary in length, a corresponding kitchen timer measuring only hours and minutes may be of limited use in measuring runners in a 100 meter race, whereas the high accuracy of a stopwatch may be wasted measuring the cooking of a turkey. Moreover, since a given timer is often used for measuring different events, it would be advantageous for a timer to have the ability to switch between different levels of accuracy at the direction of the user.

Conventional timers of which the instant inventors are aware do not have such an ability. For example, the game timer described in published U.S. Patent Application No. US/2001/0034256 A1 may be initially displayed in hours and decrease in one hour increments until less than one hour remains. At that point, the time display automatically switches to minutes and decreases in one minute increments. When less than one minute remains, the time display automatically switches to seconds and decreases in one second increments.

III. SUMMARY OF THE INVENTION

It is an object of the invention to provide a timer that permits a user to choose a mode of operation that is best suited to the user's need.

It is another object of the invention to provide a timer that allows a user to conveniently switch between various display modes, each mode having a different degree of timing resolution.

It is yet another object of the invention to provide a timer that can simultaneously time multiple events.

It is a further object of the invention to provide a timer with broad consumer appeal.

These and other objects may be accomplished, according to the invention, by a timer that includes a timing device that generates first and second time counts responsive to user input. The timer further includes a display that displays the first time count in one of a first set of time units and a second set of time units. A user actuatable device is operatively connected to the display and causes the display to clear the first time count and display the second time count.

IV. BRIEF DESCRIPTION OF THE DRAWINGS

V. DETAILED DESCRIPTION OF THE DRAWINGS

Figure 1:
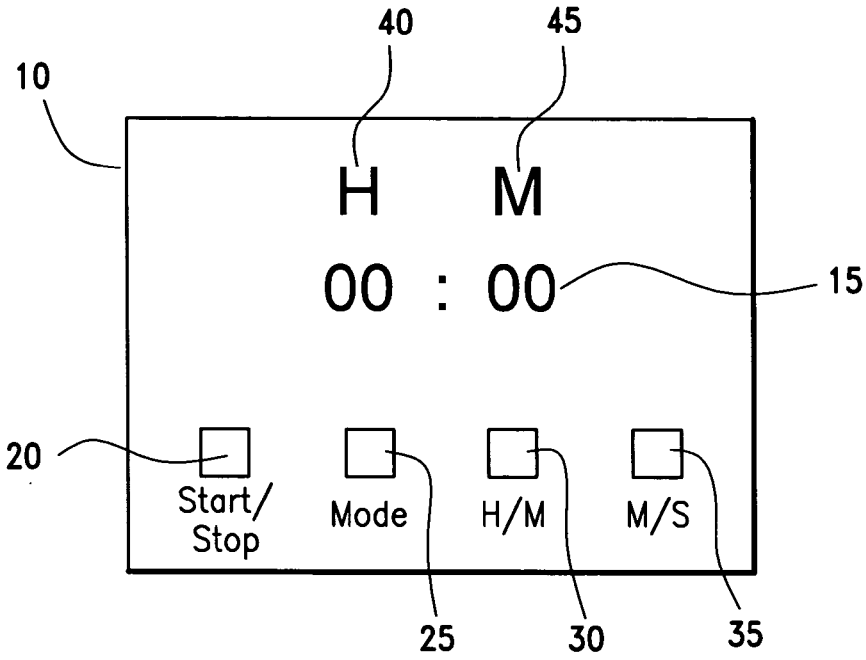
FIG. 1 depicts a display according to the invention illustrating the display time field in time units of hours and minutes.
Figure 2:
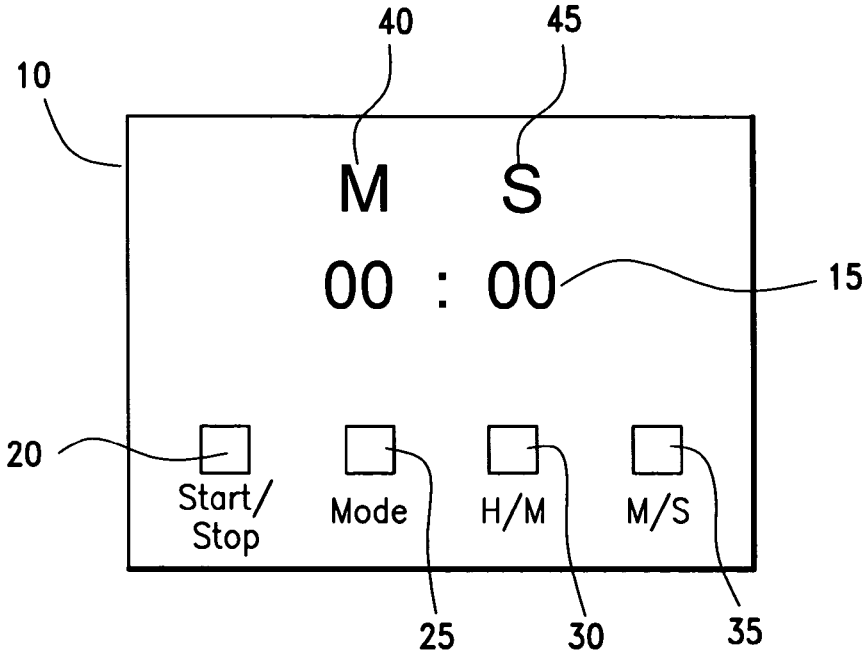
FIG. 2 shows a display according to the invention depicting the display time field in time units of minutes and seconds

FIGS. 1 and 2 illustrate a first embodiment of a timer 10 according to the invention. An exemplary timer 10 includes timing device 17 (FIG. 3) for generating a time count, a time display 15 that displays the time count and a start/stop button 20 for initiating and concluding the time count. The timing unit may perform count up and count down functions responsive to user input. If the user wants the timer to operate as a countdown timer, the user needs to set the time or count value. In accordance with the invention, the count value may be set in at least first and second sets of time units 40 and 45, respectively. For example, H/M (hour/minute) button 30 is operable to set the number of hours in the first set of time units 40 and M/S (minute/second) button 35 is operable to set the number of minutes in the first set of time units 40. When displaying the time count in the second set of time units, H/M button 30 is operable to set the minutes in the time count and M/S button 35 is operable to set the number of seconds in the count. In this embodiment, the first set of time units 40 comprises "hours/minutes" (shown in FIG. 1) and the second set of time units 45 includes "minutes/seconds" (shown in FIG. 2).

In accordance with an aspect of the invention, timer 10 can perform multiple time counts simultaneously. Mode button 25 is operatively connected to timing circuit 17 and to display 15 and, when actuated, causes display 15 to switch between a first time count and a second time count. In operation, the user may initiate a first time count by depressing start/stop button 20. The user can clear the first time count and display a second time count by depressing mode button 25. Although the first time count is cleared from display 15, the timing unit continues the first time count independent of the status of the second time count. Like the first time count, the second time count may be actuated by depressing start/stop button 20. Accordingly, the user can cause display 15 to toggle between the first and second time counts by depressing mode button 25.

In accordance with another aspect of the invention, the first time count and the second time count may be displayed in different time units, e.g., the first set of time units 40 and the second set of time units 45, respectively. Alternatively, the first time count and the second time count may be displayed in identical time units. This is particularly useful when timing events that lend themselves to different timing resolutions, often encountered when cooking.

In accordance with another aspect of the invention, timing device 17 converts each time count from one set of time units to another. Accordingly, display 15 includes a plurality of modes defined by the first and second sets of time units 40 and 45, respectively. For example, display 15 includes an hours/minutes mode and a minutes/seconds mode. When a time count is shown on display 15, whether during the counting procedure or thereafter, the user can cause timing device 17 to convert the count from one mode to another by, for example, depressing mode button 25. Alternatively, the user can cause the timing device 17 to perform the conversion by actuating a button dedicated to the desired mode such as the H/M button 30 or the M/S button 35. For example, hours/minutes button 30 may be actuated to perform a count conversion from another mode to hours/minutes. Likewise, minutes/seconds button 35 may be actuated to perform a count conversion to minutes/seconds from another mode.

In keeping with the invention, display field 15 may comprise a greater number of time units than hours, minutes and seconds. More particularly, display field 15 may comprise up to 8 or more individual time units such as tenths of seconds, hundredths of seconds, thousandths of seconds, etc. In addition, first and second sets of time units 40 and 45, respectively, may comprise any combination of individual time units. For example, the first set of time units 40 may include hours and minutes and the second set of time units 45 may include minutes, seconds and tenths of seconds. Thus, for example, the user may toggle display field 15 between an hours/minutes mode and a minutes/seconds/tenths of seconds mode.

In keeping with another feature of the invention, display field 15 may include a plurality of modes. For example, the user may be able to switch between hours/minutes mode, minutes/seconds mode and seconds/tenths of seconds mode using mode button 25 or a button dedicated to the desired mode, i.e., hours/minutes button 30, minutes/seconds button 35, seconds/tenths of seconds button (not shown). In this way the user may choose which mode is best suited for a particular measurement, while simultaneously minimizing a size of the timer 10.

Figure 3:
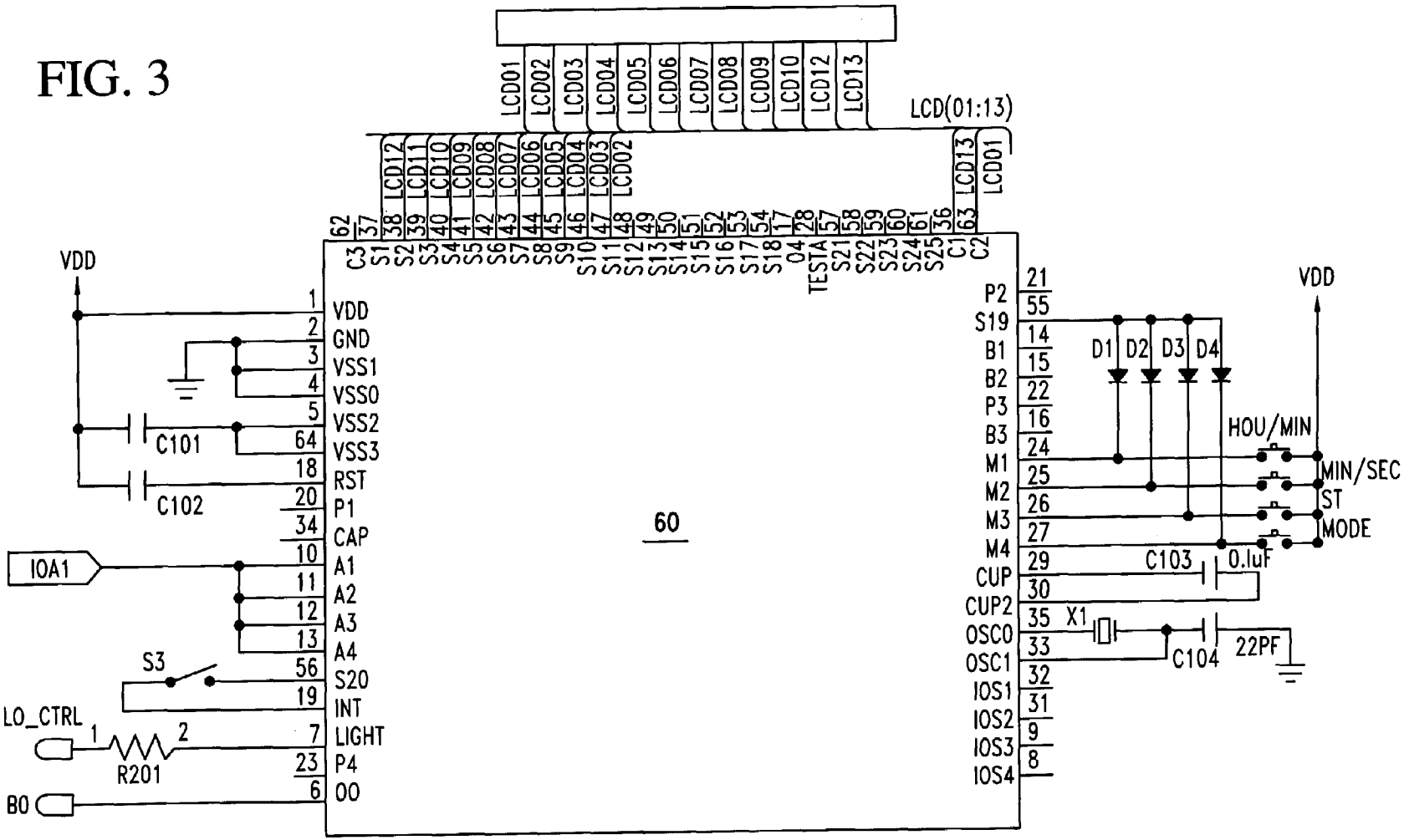
FIG. 3 illustrates a schematic diagram of an exemplary chip for implementing the functionality of the present invention.

Timing device 17 is preferably implemented by a microcontroller unit. FIG. 3 shows a preferred microcontroller unit (MCU) 60, a Multifunction Timer Pulse Unit, MTU410, available from Myson Century Semiconductor, Inc. of San Jose, Calif. MCU 60 may be a single-chip 4-bit micro-controller with LCD drivers and a built-in clock generator. MCU 60 may be AC powered or DC powered. More particularly the MCU 60 may include a 1.5 V power supply and has both countdown and count up functions. MCU 60 preferably includes an H/M mode with 19 hour 59 minute countdown and count up functions and a M/S mode with a 99 minute 59 second countdown and count up functions. When power is up, the position of switch s3 may be checked to determine the default mode. The user may toggle the mode between H/M and M/S as desired. Because pin P19 is an inner pull down pin which consumes power when it is connected to VCC, pin P56 is preferably employed to output a square wave having a frequency of about 5.8 Hz and a pulse width of about 480 μS. In this configuration, pull down pin P19 will only consume power during the 480 μs pulse amounting to about 2% of what would be consumed if pin P19 were connected to vcc. Alternatively, timing device 17 may be implemented as a hard-wired circuit, a firmware device, an ASIC or an appropriately programmed processor.

In accordance with a second embodiment of the timer 10, timing device 17 performs only a single count and does not toggle between counts. In this embodiment, a user may select a mode of operation and proceed throughout the remainder of the measurement in that mode. That is, a user selecting "hours/minutes" mode would not be able to observe the number of seconds passing without restarting the measurement in "minutes/seconds" mode. Alternatively, the user may switch between modes, and thus convert the time count, throughout the measurement. In this way, a user counting down, for example, from two hours to zero might initially select the "hours/minutes" mode. However, as the time counts down, at some point, the user might wish to switch modes so as to be able to view the number of seconds remaining as well. The user could then switch back to the "hours/minutes" mode, if desired.

In operation as a countdown timer, timing device 17 decrements the time count in units selected by the user. When the time count reaches zero, timing device 17 generates an alarm. In the embodiments having multiple time counts, to enable the user to distinguish between the expiry of the first time count and the expiry of the second time count, the timing device generates a first alarm at the expiry of the first time count and a second alarm at the expiry of the second time count. The first alarm is preferably distinct from the second alarm. For example the first and second alarms may be of different tones, durations, patterns, etc.

In some applications it is desirable to track time elapsed after the down count has reached zero. This is true, for example, in cooking when a dish must be cooked for a first period of time and must cool for a second period of time before serving. To assist the user in measuring an appropriate cooling period, at the conclusion of the alarm, without further user input, timing device 17 begins to count up and the up count is shown on display 15.

In accordance with another aspect of the countdown function, in the hours/minutes mode, during the last minute of the time count, the time count is automatically switched to seconds only. This is useful in applications where the user needs to make fine time measurements as the end of the time count approaches.

As mentioned above, although FIGS. 1 and 2 illustrate an exemplary set of buttons 25, 30 and 35, based on the teachings contained herein, it should be understood that many different display configurations could be implemented. For example, H/M button 30 and M/S button 35 may be incorporated into mode button 25 which may be additionally or separately used for other functionality, such as an alarm. Alternatively, a numeric keypad may be provided for setting the time count. In addition, mode button 25, H/M button 30 and M/S button 35 are not limited to buttons but may be any user actuatable device such as a toggle switch, a sliding switch, a dial, a knob, etc.

In FIGS. 1 and 2, "H", "M" and "S" icons are preferably displayed above numerals of display field 15 to indicate time units of hours, minutes and seconds, respectively. As previously mentioned, other representative icons may be employed to indicate other time units such as tenths of seconds, hundredths of seconds, etc. Also, certain display modes may not utilize the entire display field. For example, display field 15 may include time units of hours, minutes and seconds. However, the user may select the "minutes/seconds" display mode. In this case the hours time unit would simply be inactive.

Timer 10 of the present invention may be incorporated into various devices where time measurement is useful. For example, timer 10 may be incorporated in a timer which may be utilized either as a kitchen timer where more coarse time measurement is employed or as an athletic timer where more fine time measurement is desired since the time units may be toggled with the flip of a switch. In addition, timer 10 of the present invention may be incorporated in kitchen appliances such as a stoves, blenders, toasters, rice cookers, crock-pots, microwave ovens, etc. The timer 10 of the present invention may also be incorporated in exercise machines such as treadmills, rowing machines, stationary bikes and the like.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

I claim:

1. A timer comprising:

a timing device that generates first and second time counts responsive to user input;

a display that displays the first time count in a first set of time units and the second count in a set of time units; and a user actuatable device operatively connected to said display that causes the display to toggle between the first time count and the second time count and to convert the first count from the first set of time units to the second set of time units, wherein said timing device continues to perform the first time count after toggling between the first time count and the second time count.

2. The timer of claim 1 further comprising a user actuatable device that causes the timing device to convert the second count from the second set of time units to the first set of time units.

3. A timer comprising:

a timing device that generates first and second time counts responsive to user input, the first and second time counts being a descending time counts, said timing device generating a first alarm when the first time count reaches zero and a second alarm when the second time count reaches zero;

a display that displays the first time count in one of a first set of time units and a second set of time units; and a user actuatable device operatively connected to said display that causes the display to toggle between the first time count and the second time count.

4. The timer of claim 3 wherein said timing device initiates an up count after the second alarm is generated.

5. The timer of claim 3 wherein the first alarm is different from the second alarm.

6. A method of operation of a countdown timer comprising:

performing a descending time count responsive to user initiation;

displaying the time count in a first set of time units;

converting the displayed time count from a first set of time units to a second set of time units generating an alarm when the time count reaches zero; and performing an ascending time count after generating the alarm without user initiation.

7. The method of claim 6 wherein the first set of time units is hours/minutes and displaying the time count includes displaying the time count in seconds only during the last minute of the time count.

* * * * *